US006062519A

United States Patent [19]

Baldassarre

[11] Patent Number: 6,062,519

[45] Date of Patent: May 16, 2000

[54] RAIL COVERING SYSTEM

[76] Inventor: James Baldassarre, 355 Main St., Clinton, Mass. 01510

[21] Appl. No.: 09/164,641

[22] Filed: Oct. 1, 1998

[51] Int. Cl.[7] ..... A47K 1/08; E04F 11/16; E04C 3/30

[52] U.S. Cl. ..... 248/311.2; 52/177; 52/738.1; 52/650.3; 52/737.4

[58] Field of Search ..... 248/214, 311.2, 248/346.11, 310, 316.8, 346.01, 346.03, 346.05; 52/177, 179, 180, 181, 727; 297/218; 428/334

[56] References Cited

U.S. PATENT DOCUMENTS

| | | | |
|---|---|---|---|
| D. 183,691 | 10/1958 | Grover | 52/180 |
| 1,091,214 | 3/1914 | Gruber | 52/177 |
| 1,794,520 | 3/1931 | Kerschner | 248/67.7 |
| 4,709,519 | 12/1987 | Liefer et al. | 52/98 |
| 4,804,570 | 2/1989 | Bedics | 428/53 |
| 4,885,882 | 12/1989 | Forshee | 52/177 |
| 4,907,387 | 3/1990 | Turnbull | 52/177 |
| 5,070,664 | 12/1991 | Groh et al. | 52/177 |
| 5,326,187 | 7/1994 | St. Marie et al. | 403/402 |
| 5,794,390 | 8/1998 | Oliveri et al. | 52/177 |

*Primary Examiner*—Anita M. King
*Assistant Examiner*—Michael Nornberg

[57] ABSTRACT

A rail covering system for covering the railing of an outdoor deck to protect the railing from damage from weathering. The system includes an elongate strip having top and bottom faces, a pair of opposite ends, and a pair of sides extending between the ends of the strip. The bottom face of the strip is designed for resting on a top of a railing. Each of the sides of the strip has an elongate edge flange extending outwardly therefrom.

10 Claims, 3 Drawing Sheets

RAIL COVERING SYSTEM

BACKGROUND OF THE INVENTION

1. Field of the Invention

The present invention relates to devices for covering railing of an outdoor deck and more particularly pertains to a new rail covering system for covering the railing of an outdoor deck to protect the railing from damage from weathering.

2. Description of the Prior Art

The use of devices for covering railing of an outdoor deck is known in the prior art. More specifically, devices for covering railing of an outdoor deck heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,007,612; U.S. Pat. No. 5,240,214; U.S. Pat. No. 4,998,700; U.S. Pat. No. 5,009,380; U.S. Pat. No. 3,433,443; and U.S. Pat. No. Des. 372,620.

While these devices fulfill their respective, particular objectives and requirements, the aforementioned patents do not disclose a new rail covering system. The inventive device includes an elongate strip having top and bottom faces, a pair of opposite ends, and a pair of sides extending between the ends of the strip. The bottom face of the strip is designed for resting on a top of a railing. Each of the sides of the strip has an elongate edge flange extending outwardly therefrom.

In these respects, the rail covering system according to the present invention substantially departs from the conventional concepts and designs of the prior art, and in so doing provides an apparatus primarily developed for the purpose of covering the railing of an outdoor deck to protect the railing from damage from weathering.

SUMMARY OF THE INVENTION

In view of the foregoing disadvantages inherent in the known types of devices for covering railing of an outdoor deck now present in the prior art, the present invention provides a new rail covering system construction wherein the same can be utilized for covering the railing of an outdoor deck to protect the railing from damage from weathering.

The general purpose of the present invention, which will be described subsequently in greater detail, is to provide a new rail covering system apparatus and method which has many of the advantages of the devices for covering railing of an outdoor deck mentioned heretofore and many novel features that result in a new rail covering system which is not anticipated, rendered obvious, suggested, or even implied by any of the prior art devices for covering railing of an outdoor deck, either alone or in any combination thereof.

To attain this, the present invention generally comprises an elongate strip having top and bottom faces, a pair of opposite ends, and a pair of sides extending between the ends of the strip. The bottom face of the strip is designed for resting on a top of a railing. Each of the sides of the strip has an elongate edge flange extending outwardly therefrom.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new rail covering system apparatus and method which has many of the advantages of the devices for covering railing of an outdoor deck mentioned heretofore and many novel features that result in a new rail covering system which is not anticipated, rendered obvious, suggested, or even implied by any of the prior art devices for covering railing of an outdoor deck, either alone or in any combination thereof.

It is another object of the present invention to provide a new rail covering system which may be easily and efficiently manufactured and marketed.

It is a further object of the present invention to provide a new rail covering system which is of a durable and reliable construction.

An even further object of the present invention is to provide a new rail covering system which is susceptible of a low cost of manufacture with regard to both materials and labor, and which accordingly is then susceptible of low prices of sale to the consuming public, thereby making such rail covering system economically available to the buying public.

Still yet another object of the present invention is to provide a new rail covering system which provides in the apparatuses and methods of the prior art some of the advantages thereof, while simultaneously overcoming some of the disadvantages normally associated therewith.

Still another object of the present invention is to provide a new rail covering system for covering the railing of an outdoor deck to protect the railing from damage from weathering.

Yet another object of the present invention is to provide a new rail covering system which includes an elongate strip having top and bottom faces, a pair of opposite ends, and a pair of sides extending between the ends of the strip. The bottom face of the strip is designed for resting on a top of a railing. Each of the sides of the strip has an elongate edge flange extending outwardly therefrom.

Still yet another object of the present invention is to provide a new rail covering system that protects users from injury from splinters on deck railings.

Even still another object of the present invention is to provide a new rail covering system that can also be used to cover banisters.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
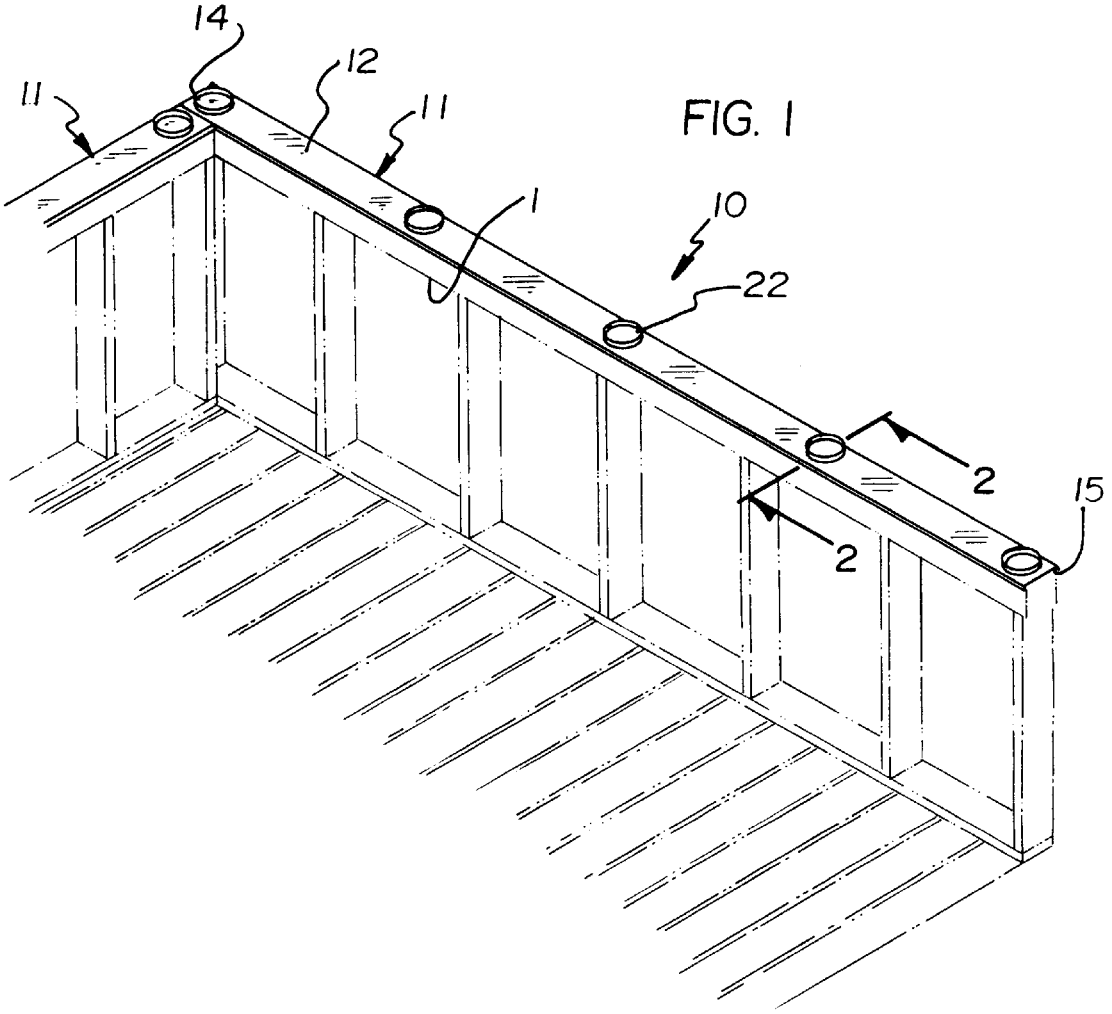
FIG. 1 is a schematic perspective view of a new rail covering system having perimeter walls in use covering the railing of a deck according to the present invention.

With reference now to the drawings, and in particular to FIGS. 1 through 6 thereof, a new rail covering system embodying the principles and concepts of the present invention and generally designated by the reference numeral 10 will be described.

A covering system 10 is designed for covering the top of a railing 1 or a banister 2. As best illustrated in FIGS. 1 through 6, the rail covering system 10 generally comprises an elongate strip 11 having top and bottom faces 12,13, a pair of opposite ends 14,15, and a pair of sides 16,17 extending between the ends 14,15 of the strip 11. The bottom face 13 of the strip 11 is designed for resting on a top of a railing 1. Each of the sides 16,17 of the strip 11 has an elongate edge flange 18,19 extending outwardly therefrom.

Specifically, the elongate strip 11 is generally rectangular and has generally planar top and bottom faces 12,13, a pair of opposite ends 14,15, and a pair of elongate sides 16,17 extending between the ends 14,15 of the strip 1. Preferably, the top and bottom faces 12,13 of the strip 11 lying in generally parallel planes. Ideally, the strip 11 comprises a vinyl material adapted for resisting damage and weathering from prolonged outside exposure.

The strip 11 has a length defined between the ends 14,15 of the strip 11, a width defined between the sides 16,17 of the strip 11, and a thickness defined between the top and bottom faces 12,13 of the strip 11. Preferably, the length of the strip 11 is greater than about 4 feet and the width of the strip 11 is greater than about 1 inch, and the thickness of the strip 11 is greater than $\frac{1}{8}^{th}$ inch. In an ideal illustrative embodiment, the length of the strip 11 is about 8 inches, the width of the strip 11 is about 6 inches, and the thickness of the strip 11 is about ¼ inch. The width of the strip 11 may also come in 1¾ inch, 3¾ inch, and 5½ inch versions to fit various standard sized railings 1.

In use, the bottom face 13 of the strip 11 is designed for resting on a top of a railing 1 such that the length of the strip 11 extends 14,15 along a length of the railing 1. The strip 11 is also designed for attachment to the railing 1 by the extension of fasteners such as nails and screws through the top and bottom faces 12,13 of the strip 11 into the railing 1.

Each of the sides 16,17 of the strip 11 has an elongate edge flange 18,19 extending outwardly and downwardly therefrom. Each of the edge flanges 18,19 has a length extending between the ends 14,15 of the strip 11. Each of the edge flanges 18,19 lies in a plane extending an obtuse angle from the plane of the bottom face 13 of the strip 11. Preferably, the obtuse angle of each of the edge flanges 18,19 is between about 100° and about 160°. Ideally, the obtuse angle is about 135°. Each of the edge flanges 18,19 terminating at a terminal edge 20,21. The terminal edges 20,21 of the edge flanges 18,19 lie in planes generally parallel to the bottom face 13 of the strip 11. Ideally, the terminal edges 20,21 of the edge flanges 18,19 are coplanar. Each of the edge flanges 18,19 has a width defined between the adjacent side of the strip 11 and the associated terminal edge 20,21. Preferably, the widths of the edge flanges 18,19 are generally equal. Ideally, the width of each of the edge flanges 18,19 is about 1 inch.

Figure 2:
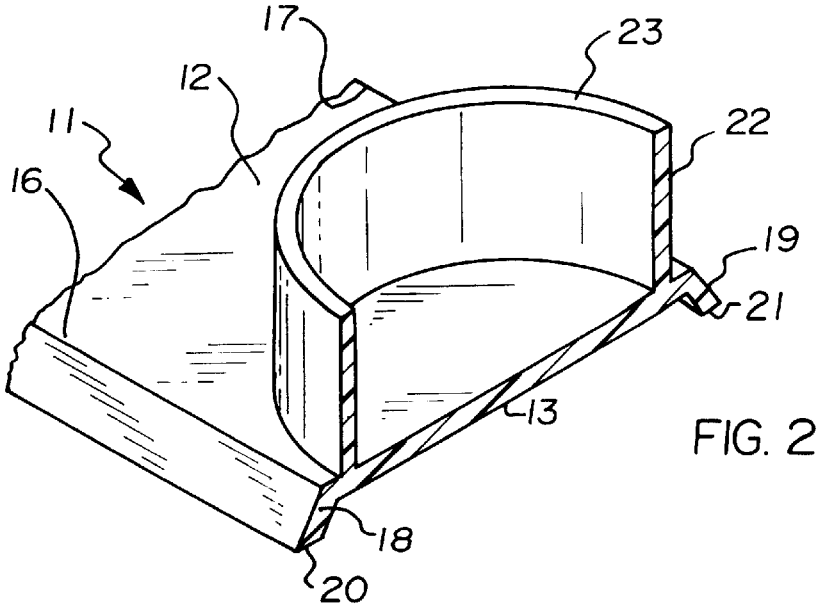
FIG. 2 is a schematic cross sectional view of a perimeter wall of the present invention taken from line 2—2 of FIG. 1.

In a preferred embodiment, as illustrated in FIGS. 1 and 2, the top face 12 of the strip 11 has a plurality of spaced apart perimeter walls 22 upwardly extending therefrom with each perimeter wall 22 defining a space for receiving items therein. Preferably, each of the perimeter walls 22 is generally cylindrical and has an upper edge 23, a longitudinal axis, and a diameter. This preferred configuration is designed for best receiving therein a beverage container such as a cup, glass and a beverage can. The longitudinal axes of the perimeter walls 22 is extended generally perpendicular to the top face 12 of the strip 11. The upper edge 23 of each of the perimeter walls 22 lie in planes generally parallel to the top face 12 of the strip 11. Ideally, the upper edges 23 of the perimeter walls 22 lie in a common plane such that the perimeter walls 22 all are of an equal height defined between the upper edge 23 of the perimeter wall 22 and the top face 12 of the strip 11. The diameter of each of the perimeter walls 22 is between about one-half the width of the strip 11 and the width of the strip 11. Preferably, the diameter of each of the perimeter walls 22 is less than the width of the strip 11. The perimeter walls 22 are arranged on the top face 12 of the strip 11 in a row extending between the ends 14,15 of the strip 11. The perimeter walls 22 are preferably spaced apart in generally equal intervals along the row. Preferably, the interval between adjacent perimeter walls 22 is greater than about 3 inches. Ideally, the interval between adjacent perimeter walls 22 is about 24 inches.

Figure 3:
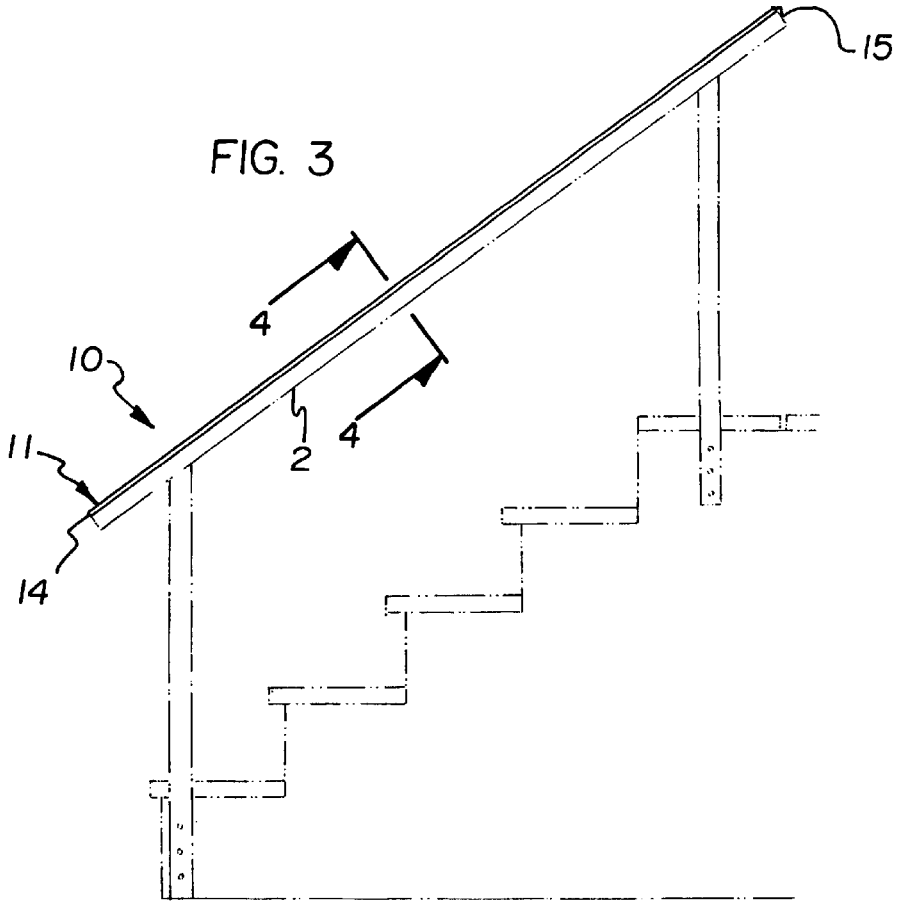
FIG. 3 is a schematic side view of the present invention in use covering a banister of a flight of stairs.
Figure 4:
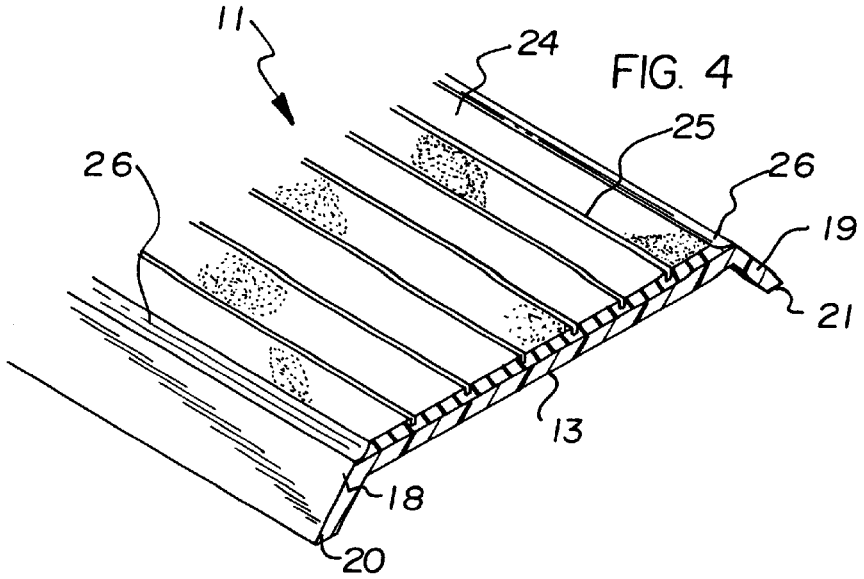
FIG. 4 is a schematic cross sectional view of the present invention having an upper gripping surface taken from line 4—4 of FIG. 3.
Figure 5:
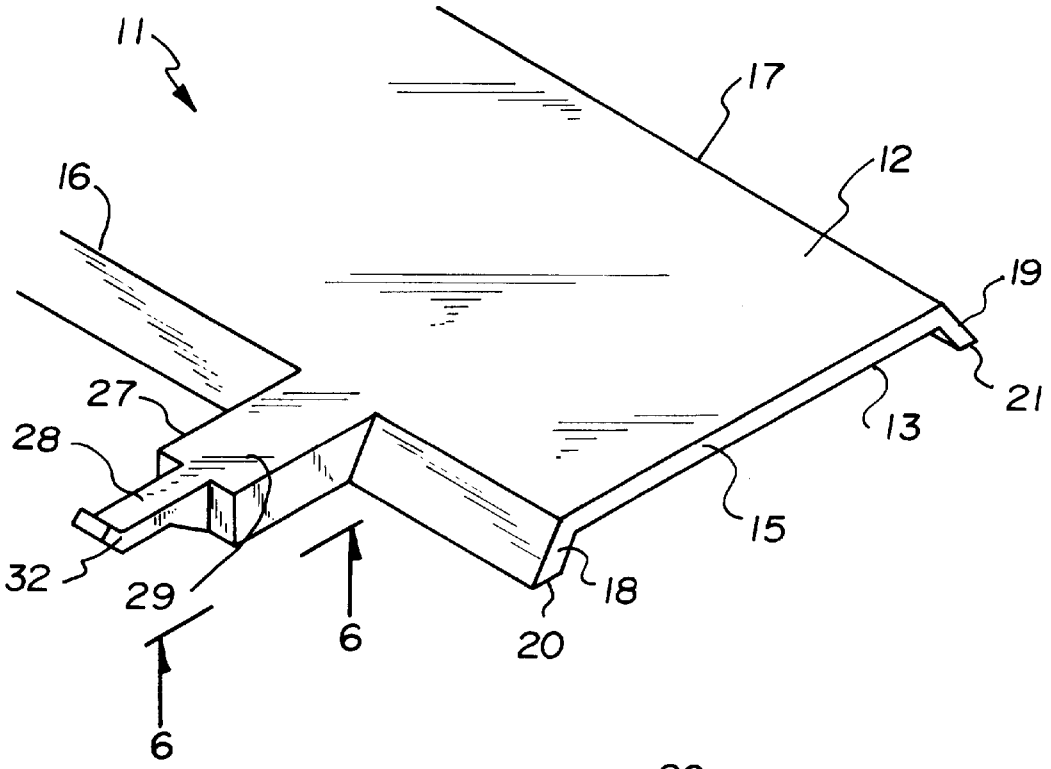
FIG. 5 is a schematic partial perspective view of an end of a strip of the present invention having an extent.
Figure 6:
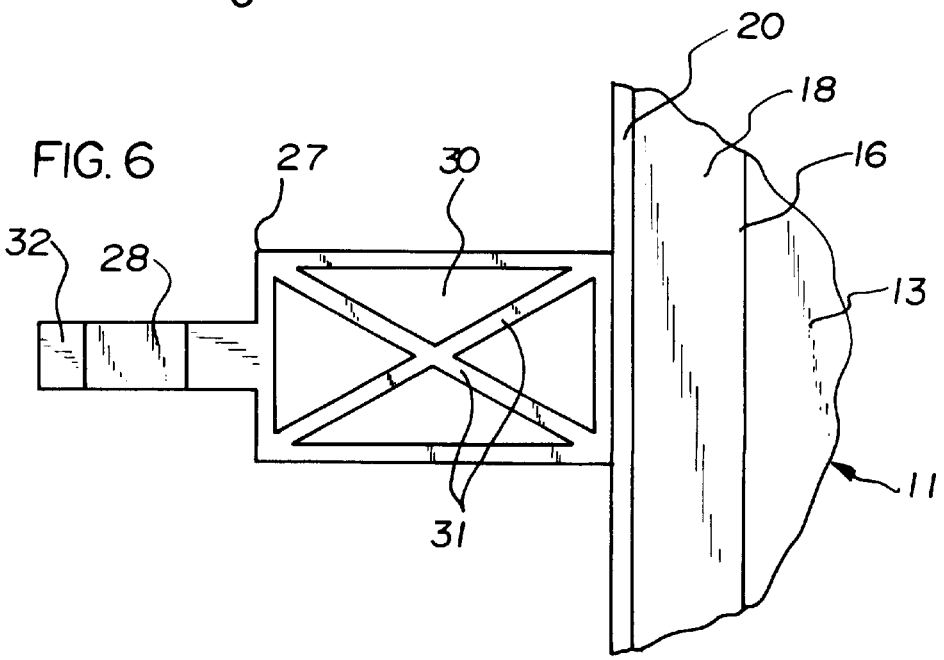
FIG. 6 is a schematic bottom side view of the extent of the present invention taken from the vantage of line 6—6 of FIG. 5.

In another preferred embodiment, as illustrated in FIGS. 3 and 4, the top face 12 of the strip 11 has an upper gripping surface 24 provided thereon. This upper gripping surface may also be used in embodiments having the plurality of perimeter walls. The upper gripping surface 24 has a length extending between the ends 14,15 of the strip 11 and a width extending between the sides 16,17 of the strip 11. The upper gripping surface 24 has a plurality of generally parallel elongate grooves 25 extending along the length of the upper gripping surface 24. The elongate grooves 25 are designed for enhancing the grip of a user grasping the railing 1 and the strip 11. The upper gripping surface 24 comprises an resiliently compressible material for enhancing the grip of a user grasping the railing 1 and the strip 11. Ideally, the upper gripping surface 24 comprises a resiliently compressible rubber. The upper gripping surface 24 preferably has a pair of arcuate beveled sides 26. Each arcuate beveled side 26 is positioned adjacent an associated side 16,17 of the strip 11. Each of the arcuate beveled sides 26 has a length extending between the ends 14,15 of the strip 11.

An extent 27 may be outwardly extended from one of the edge flanges of the strip 11. The extent 27 terminates at a hook 28 for hanging objects thereon such as planters, hats, and clothing. The extent 27 has a generally planar top side 29 and a bottom side 30. The top side 29 of the extent 27 is preferably generally coplanar with the top face 12 of the strip 11. The bottom side 30 of the extent 27 preferably has a pair of reinforcing ribs 31 for providing additional reinforcement to the extent 27. Ideally, the reinforcing ribs 31 are arranged in a generally X-shaped configuration. The hook 28 of the extent 27 has a portion 32 extending upwardly from the top side 29 of the extent 27 for helping hold things on the extent 27.

In use, a set of the strips may be used to cover an entire railing 1 of a outdoor deck as illustrated in FIG. 1 or the banister 2 of a flight of stairs as illustrated in FIG. 3. The strips provide protection to the railing or banister from wear and damage. The strips may also provide spaces for holding items, hooks for hanging items and a surface for aiding the grip of a user when holding on to a strip.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A covering system for covering the top of a railing, said covering system comprising:

an elongate strip having top and bottom faces, a pair of opposite ends, and a pair of sides extending between said ends of said strip;

said strip having a length defined between said ends of said strip, a width defined between said sides of said strip, and a thickness defined between said top and bottom faces of said strip;

said bottom face of said strip being adapted for resting on a top of a railing; and each of said sides of said strip having an elongate edge flange extending outwardly therefrom;

wherein each of said edge flanges lies in a plane extending at an obtuse angle from a plane of said bottom face of said strip;

wherein said top face of said strip has a plurality of spaced apart perimeter walls extending therefrom, each perimeter wall defining a space for receiving a beverage container therein to resist unintended movement of the container off of said top face of said strip, each of said perimeter walls being generally cylindrical and having an upper edge, longitudinal axis, and a diameter, each of said perimeter walls being adapted for receiving therein a beverage container; and wherein said top face of said strip has an upper gripping surface provided thereon, said upper gripping surface having a length extending between said ends of said strip and a width extending between said sides of said strip.

2. The covering system of claim 1, wherein said top and bottom faces of said strip lie in generally parallel planes.

3. The covering system of claim 1, wherein said obtuse angle of each of said edge flanges is between about 100° and about 160°.

4. The covering system of claim 1, wherein said obtuse angle is about 135°.

5. The covering system of claim 1, wherein said longitudinal axes of said perimeter walls are extended generally perpendicular to said top face of said strip.

6. The covering system of claim 1, wherein said upper gripping surface has a plurality of generally parallel elongate grooves extending along said length of said upper gripping surface.

7. The covering system of claim 1, wherein said upper gripping surface comprises a resiliently compressible material.

8. The covering system of claim 1, wherein said upper gripping surface has a pair of arcuate beveled sides, each arcuate beveled side being positioned adjacent an associated side of said strip, each of said arcuate beveled sides having a length extending between said ends of said strip.

9. A covering system for covering the top of a railing, said covering system comprising:

an elongate strip being generally rectangular and having generally planar top and bottom faces, a pair of opposite ends, and a pair of elongate sides extending between said ends of said strip;

wherein said strip comprises a vinyl material;

said strip having a length defined between said ends of said strip, a width defined between said sides of said strip, and a thickness defined between said top and bottom faces of said strip;

wherein said length of said strip is about 8 inches;

wherein said width of said strip is about 6 inches;

wherein said thickness of said strip is about ¼ inch;

said top and bottom faces of said strip lying in generally parallel planes;

said bottom face of said strip being adapted for resting on a top of a railing such that said length of said strip extends along a length of the railing;

said strip being adapted for attachment to the railing by the extension of fasteners through said top and bottom faces of said strip into the railing;

each of said sides of said strip having an elongate edge flange extending outwardly and downwardly therefrom, each of said edge flanges having a length extending between said ends of said strip;

each of said edge flanges lying in a plane extending an obtuse angle from the plane of said bottom face of said strip, wherein said obtuse angle is about 135°;

each of said edge flanges terminating at a terminal edge, said terminal edges of said edge flanges lying in planes generally parallel to said bottom face of said strip, wherein said terminal edges of said edge flanges are coplanar;

wherein each of said edge flanges has a width defined between the adjacent side of said strip and the associated terminal edge, wherein said widths of said edge flanges are generally equal, wherein said width of each of said edge flanges is about 1 inch;

said top face of said strip having a plurality of spaced apart perimeter walls extending therefrom, each perimeter wall defining a space for receiving items therein;

each of said perimeter walls being generally cylindrical and having an upper edge, longitudinal axis, and a diameter, each of said perimeter walls being adapted for receiving therein a beverage container;

said longitudinal axes of said perimeter walls being extended generally perpendicular to said top face of said strip;

said upper edge of each of said perimeter walls lying in planes generally parallel to said top face of said strip, wherein said upper edges of said perimeter walls lie in a common plane;

said diameter of each of said perimeter walls being between about one-half the width of said strip and said width of said strip, wherein said diameter of each of said perimeter walls is less than said width of said strip;

said perimeter walls being arranged on said top face of said strip in a row extending between said ends of said strip, said perimeter walls being spaced apart in generally equal intervals along said row, wherein said interval between adjacent perimeter walls is about 24 inches;

said top face of said strip having an upper gripping surface provided thereon, said upper gripping surface having a length extending between said ends of said strip and a width extending between said sides of said strip;

said upper gripping surface having a plurality of generally parallel elongate grooves extending along said length of said upper gripping surface;

said upper gripping surface comprising a resiliently compressible material;

said upper gripping surface having a pair of arcuate beveled sides, each arcuate beveled side being positioned adjacent an associated side of said strip, each of said arcuate beveled sides having a length extending between said ends of said strip;

an extent being outwardly extended from one of said edge flanges of said strip, said extent terminating at a hook for hanging objects thereon;

said extent having a generally planar top side and a bottom side, said top side of said extent being generally coplanar with said top face of said strip;

said bottom side of said extent having a pair of reinforcing ribs, said reinforcing ribs being arranged in a generally X-shaped configuration; and said hook of said extent having a portion extending upwardly from said top side of said extent.

10. The covering system of claim 1, further comprises an extent being outwardly extending from one of said edge flanges of said strip, said extent terminating at a hook for hanging objects thereon, a bottom side of said extent having a pair of reinforcing ribs, said reinforcing ribs being arranged in a generally X-shaped configuration.

* * * * *